US010612378B2

(12) United States Patent
Zhang et al.

(10) Patent No.: US 10,612,378 B2
(45) Date of Patent: Apr. 7, 2020

(54) METHOD FOR RECOVERING ROOM-MINING COAL PILLARS BY SOLID FILLING IN SYNERGY WITH ARTIFICIAL PILLARS

(71) Applicant: CHINA UNIVERSITY OF MINING AND TECHNOLOGY, Jiangsu (CN)

(72) Inventors: Jixiong Zhang, Jiangsu (CN); Qiang Zhang, Jiangsu (CN); Xiancheng Mei, Jiangsu (CN); Kun Fang, Jiangsu (CN); Xiaole Han, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/300,586

(22) PCT Filed: Nov. 21, 2016

(86) PCT No.: PCT/CN2016/106614
§ 371 (c)(1),
(2) Date: Nov. 12, 2018

(87) PCT Pub. No.: WO2018/045632
PCT Pub. Date: Mar. 15, 2018

(65) Prior Publication Data

US 2019/0301283 A1 Oct. 3, 2019

(30) Foreign Application Priority Data

Sep. 8, 2016 (CN) ..... 2016 1 0812671

(51) Int. Cl.
*E21F 15/00* (2006.01)
*E21F 15/02* (2006.01)
(Continued)

(52) U.S. Cl.
CPC ..... *E21D 23/0481* (2013.01); *E21F 15/00* (2013.01); *E21F 15/005* (2013.01);
(Continued)

(58) Field of Classification Search
CPC . E21F 15/02; E21F 15/06; E21F 15/08; E21F 15/00; E21F 15/005; E21F 15/04;
(Continued)

(56) References Cited

U.S. PATENT DOCUMENTS 2,634,960 A * 4/1953 Lang ..... E21C 41/16 299/11
3,999,804 A * 12/1976 Simpson ..... E21C 41/18 299/11

(Continued)

FOREIGN PATENT DOCUMENTS

CN 101487392 7/2009
CN 101725352 6/2010

(Continued)

OTHER PUBLICATIONS

"International Search Report (Form PCT/ISA/210)", dated Jun. 16, 2017, with English translation thereof, pp. 1-4.

*Primary Examiner* — David J Bagnell
*Assistant Examiner* — Michael A Goodwin
(74) *Attorney, Agent, or Firm* — JCIPRNET

(57) ABSTRACT

A method for recovering room-mining coal pillars by solid filling in synergy with artificial pillars. Solid materials and cementing materials on the ground are conveyed through a feeding well and a pipeline to a room-and-pillar goaf, a plurality of artificial pillars is cast at an interval in a coal room area, and gangue is cast to fill other regions of the coal room using a gangue casting machine. Under joint support by the artificial pillars and the coal room filler, coal pillars are recovered using a continuous coal mining machine,
(Continued)

artificial pillars are cast in the original coal pillar area after recovery, and gangue is cast to fill the original coal pillar area using the gangue casting machine. A system for recovering room-mining coal pillars by solid filling in synergy with artificial pillars mainly includes a material conveying system, a joint support system, and a coal pillar recovery system.

2 Claims, 4 Drawing Sheets

(51) Int. Cl.
*E21C 41/18* (2006.01)
*E21D 23/04* (2006.01)
*E21F 15/06* (2006.01)

(52) U.S. Cl.
CPC ..... *E21F 15/02* (2013.01); *E21F 15/06* (2013.01); *E21C 41/18* (2013.01)

(58) Field of Classification Search
CPC ..... E21F 15/10; E21C 41/16; E21C 41/18; E21C 41/20; E21C 41/22
See application file for complete search history.

(56) References Cited

U.S. PATENT DOCUMENTS

| | | | | | |
|---|---|---|---|---|---|
| 4,378,132 | A * | 3/1983 | Spies | E21F 7/00 | 299/11 |
| 4,440,449 | A * | 4/1984 | Sweeney | E21C 41/24 | 299/11 |
| 4,522,537 | A * | 6/1985 | Kuck | E21D 15/48 | 299/11 |
| 5,567,018 | A * | 10/1996 | Hart | E21C 27/02 | 299/11 |
| 2003/0168903 | A1 * | 9/2003 | Fourie | E21C 41/16 | 299/11 |

FOREIGN PATENT DOCUMENTS

| | | | | |
|---|---|---|---|---|
| CN | 103527196 | | 1/2014 | |
| CN | 103291303 B | * | 2/2016 | |
| CN | 105971606 | | 9/2016 | |
| CN | 106014412 A | * | 10/2016 | E21C 41/20 |
| EP | 0184720 A1 | * | 6/1986 | E21C 41/20 |
| RU | 2390633 | | 5/2010 | |

* cited by examiner

METHOD FOR RECOVERING ROOM-MINING COAL PILLARS BY SOLID FILLING IN SYNERGY WITH ARTIFICIAL PILLARS

CROSS-REFERENCE TO RELATED APPLICATION

This application is a 371 application of an international PCT application serial no. PCT/CN2016/106614, filed on Nov. 21, 2016, which claims the priority benefits of China Application No. 201610812671.7, filed on Sep. 8, 2016. The entirety of each of the above-mentioned patent applications is hereby incorporated by reference herein and made a part of this specification.

BACKGROUND OF THE INVENTION

Field of the Invention

The present invention relates to a method for recovering room-mining coal pillars, and in particular, to a method for recovering room-mining coal pillars which is applicable to resource recovery of room-mining coal pillars and prevention against disasters caused by residual room-mining coal pillars.

Description of Related Art

Room-and-pillar mining has been commonly used in mining areas of Western China for a long time, and as a result, a large quantity of coal pillars cannot be recovered. Taking Yulin in Shaanxi province as an example, there are 247 coal mines altogether in Yulin, and 75% of them, that is, 201 mines, adopt room-and-pillar mining. The coal recovery rate of the room-and-pillar coal mining method is merely 30% to 50%, and in Ordos alone, the quantity of room-mining coal pillars is nearly 7 billion tons, which is a great waste of national resources. In addition, the weakening in strength of the coal pillars under long-term loading is getting more and more obvious, and may pose serious safety hazards.

Currently, scholars at home and abroad have made certain achievements in the study of methods for recovering room-mining coal pillars. However, most of the methods have defects of low recovery rate and low mechanization degree. In addition, regarding a conventional method of replacing room-mining coal pillars by backfilling, the recovery cost of coal pillars is high, and the filling and recovery process is rather complicated. Therefore, it is of great practical significance and broad application prospects to study a method for recovering room-mining coal pillars which is safe and capable of increasing the recovery rate of coal resources and saving the recovery cost.

SUMMARY OF THE INVENTION

Technical Problem

To solve the defects in the prior art, an objective of the present invention is to provide a method for recovering room-mining coal pillars by solid filling in synergy with artificial pillars, which is simple to operate and efficient and has a high recovery rate.

Technical Solution

A method for recovering room-mining coal pillars by solid filling in synergy with artificial pillars provided by the present invention includes the following steps.

a. Under a joint support to overlying strata by a filler in synergy with artificial pillars, recovering room-mining coal pillars using a continuous coal mining machine:

firstly, conveying solid materials and cementing materials on a ground through a feeding well and a conveying pipeline to a room-and-pillar goaf.

b. Casting a plurality of artificial pillars at an interval in the room-and-pillar goaf between the room-mining coal pillars, filling areas between the cast artificial pillars, and by tamping and reinforcing, to form a coal room filler.

c. Under the joint support by the cast artificial pillars and the coal room filler, recovering the room-mining coal pillars one-by-one in a joint support area using the continuous coal mining machine till all the room-mining coal pillars are recovered.

The recovery process of the room-mining coal pillar includes the following steps.

a. Firstly constructing square pillar grooves having sides of 4 m long at an interval in the room-and-pillar goaf on one side of the room-mining coal pillar, and building retaining walls in the constructed square pillar grooves, where the retaining walls are required to be tightly sealed and contact a roof completely and closely.

b. Constructing artificial pillars by injecting slurry into the constructed square pillar grooves, and when a height of the slurry for casting the artificial pillars reaches a position that is 50 mm below the roof, increasing a concentration of the slurry and performing roof-contacted filling on the artificial pillars.

c. After casting of the artificial pillars, casting gangue to fill the room-and-pillar goaf using a gangue casting machine, and also, tamping and reinforcing using a bulldozer.

d. Repeating Steps a to c to complete filling of the room-and-pillar goaf on the other side of the room-mining coal pillar.

e. After a strength of the artificial pillars and the coal room filler reaches initial rock stress, recovering the room-mining coal pillar using the continuous coal mining machine in a horizontal recovery manner, the recovery being carried out in a cross-shuttling order.

f. Casting artificial pillars in the area of the recovered room-mining coal pillar, and casting gangue to fill the area of the room-mining coal pillar using the gangue casting machine, thus achieving "mining first and filling later" on a working face.

The artificial pillars are cast at an interval of 15 m to 17 m, most preferably 16 m.

Advantageous Effect

The above technical solution of the present invention enables safe and efficient recovery of resources of residual room-mining coal pillars, and is economical, and is of great significance in engineering researches. The technical solution is particularly applicable to resource recovery of room-mining coal pillars and prevention against disasters caused by residual room-mining coal pillars. Compared with the prior art, the present invention significantly reduces investment on room-and-pillar recovery on the premise of ensuring safe recovery of residual room-mining coal pillars and high recovery rate of coal resources, simplifies the filling and recovery process, and opens up new possibilities for recovery of residual room-mining coal pillars under similar conditions in China. The present invention can increase the recovery rate of coal resources and enrich room-mining coal pillar recovery theories and technologies in China while promoting harmonious development of environmental protection and resource exploitation, and is of great scientific and engineering significance. The method is simple, convenient to operate, and widely applicable in the art.

BRIEF DESCRIPTION OF THE DRAWINGS

FIG. 2(*b*) is a cross-sectional view of arrangement of artificial pillars in the method for recovering room-mining coal pillars by solid filling in synergy with artificial pillars according to the present invention.

FIG. 3(*b*) is a cross-sectional view of reinforcement and filling state in the method for recovering room-mining coal pillars by solid filling in synergy with artificial pillars according to the present invention.

FIG. 4(*b*) is a cross-sectional view of recovering and filling state in the method for recovering room-mining coal pillars by solid filling in synergy with artificial pillars according to the present invention.

Figure 1:
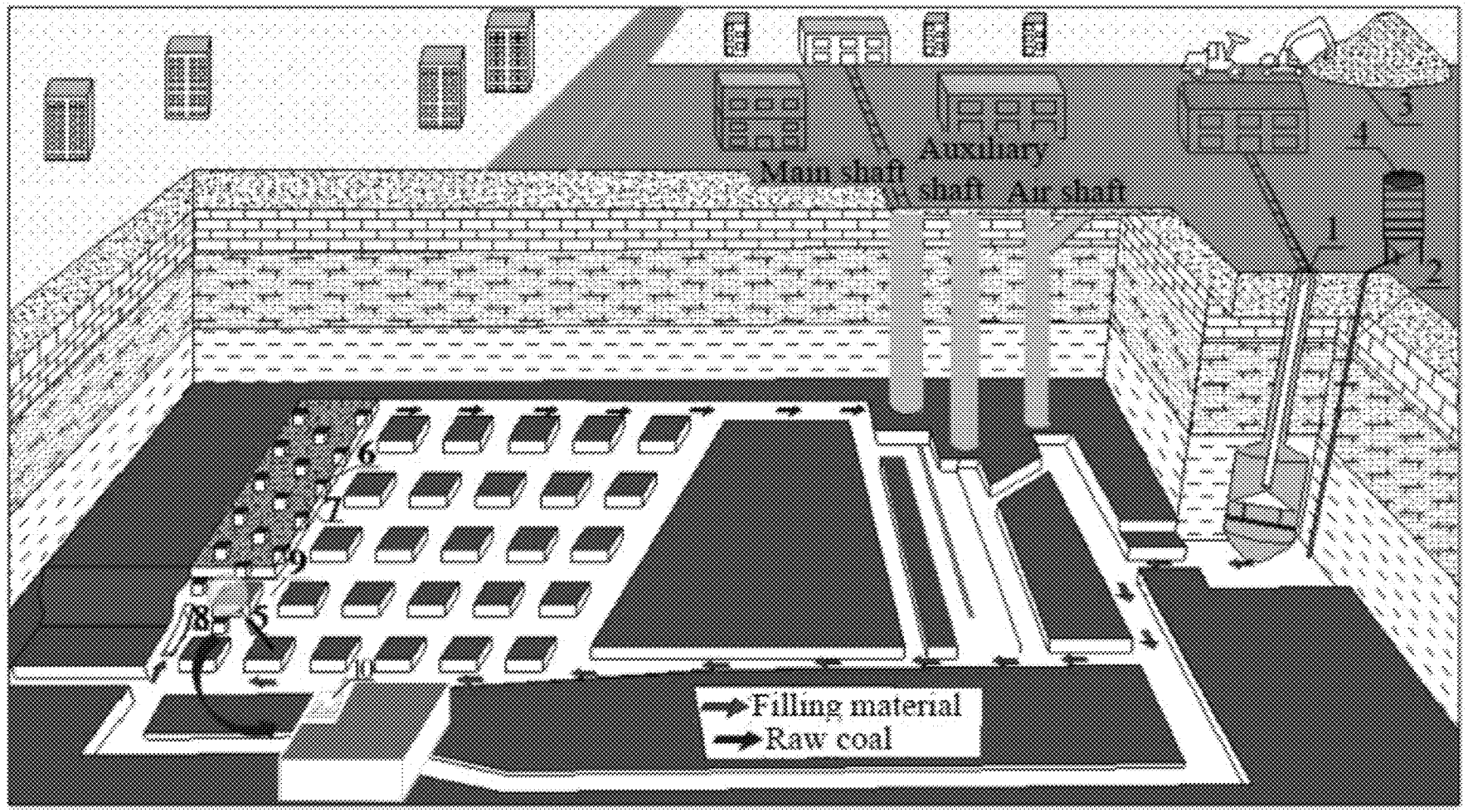
FIG. 1 is a diagram illustrating the technical principle of a method for recovering room-mining coal pillars by solid filling in synergy with artificial pillars according to the present invention.
Figure 2A:
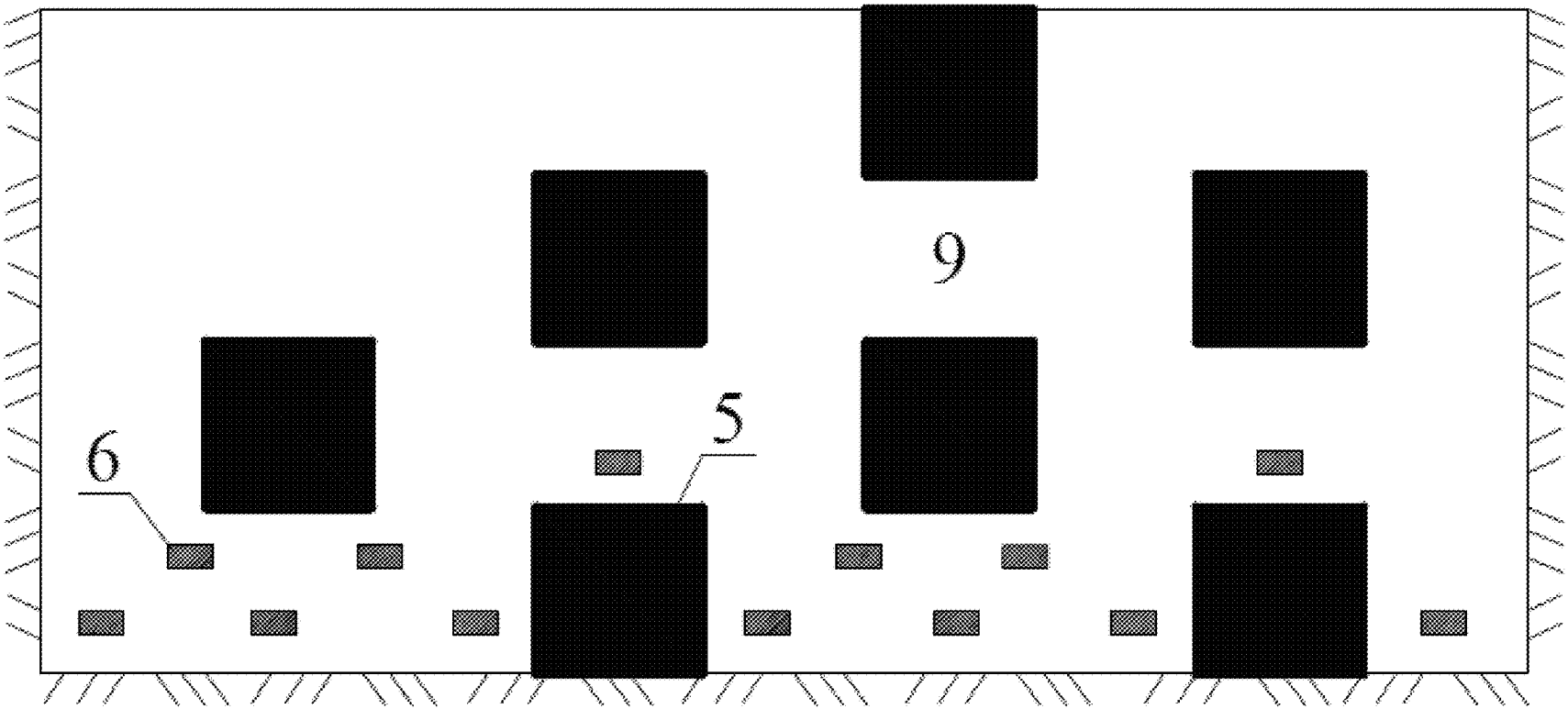
FIG. 2(*a*) is a top view of arrangement of artificial pillars in the method for recovering room-mining coal pillars by solid filling in synergy with artificial pillars according to the present invention.
Figure 2B:
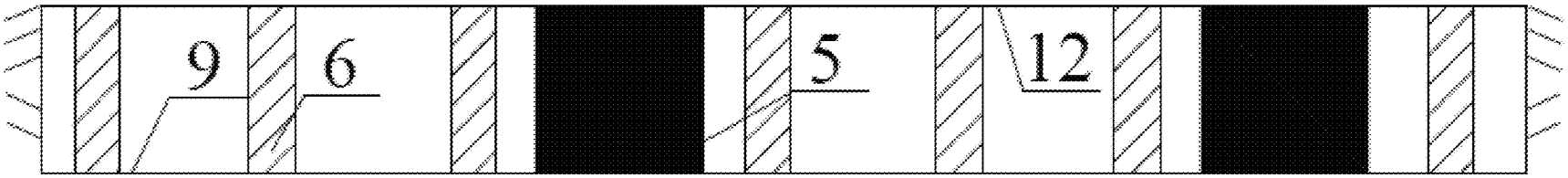
Figure 3A:
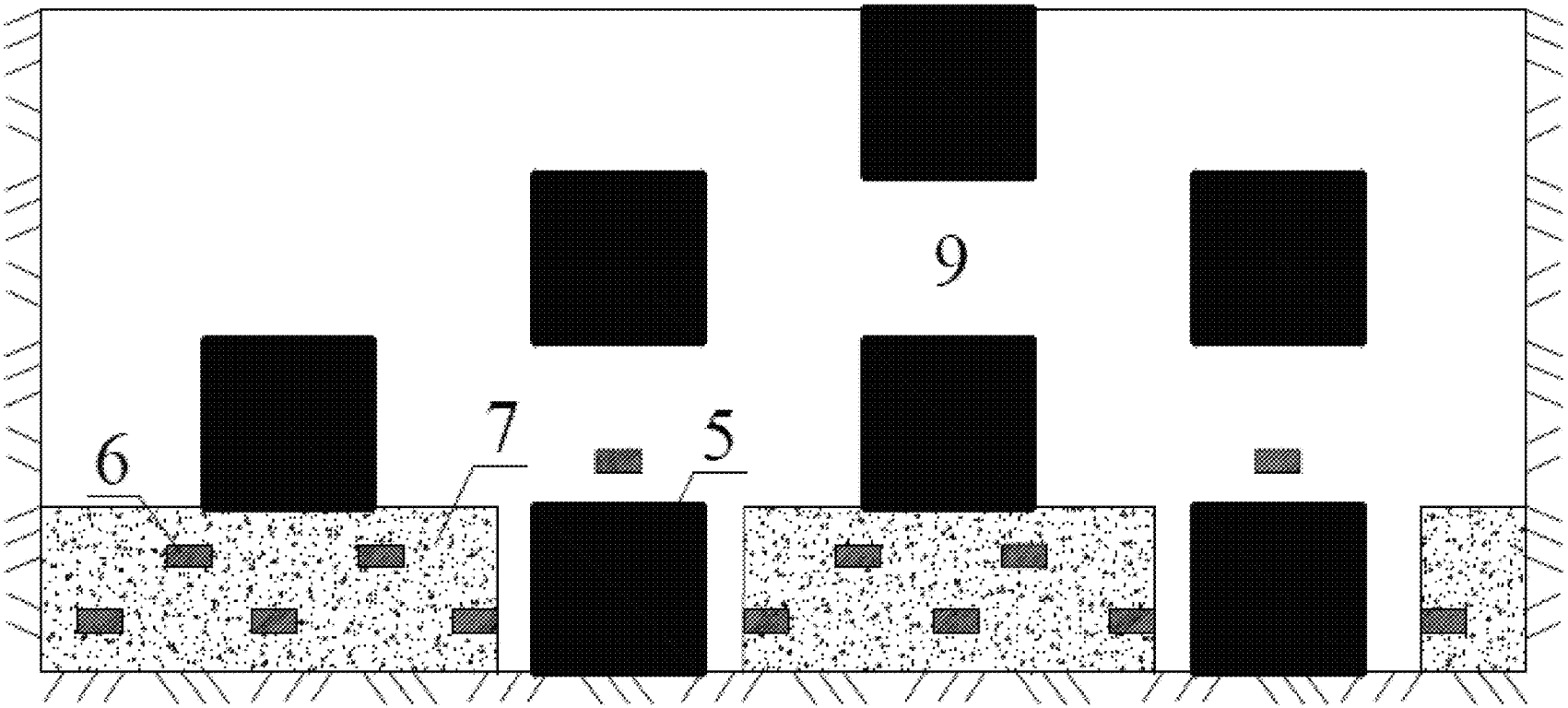
FIG. 3(*a*) is a top view of reinforcement and filling state in the method for recovering room-mining coal pillars by solid filling in synergy with artificial pillars according to the present invention.
Figure 3B:
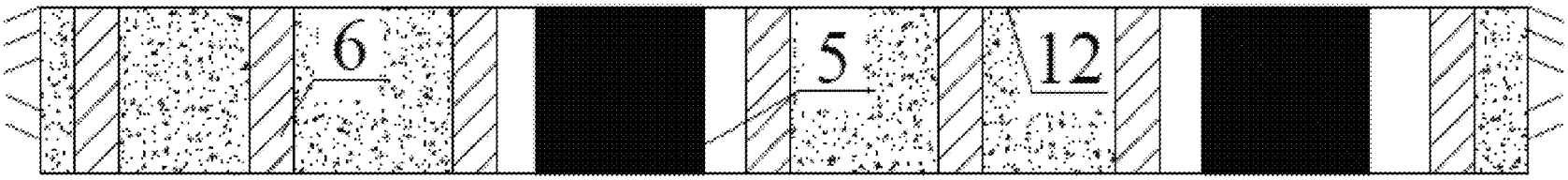
Figure 4A:
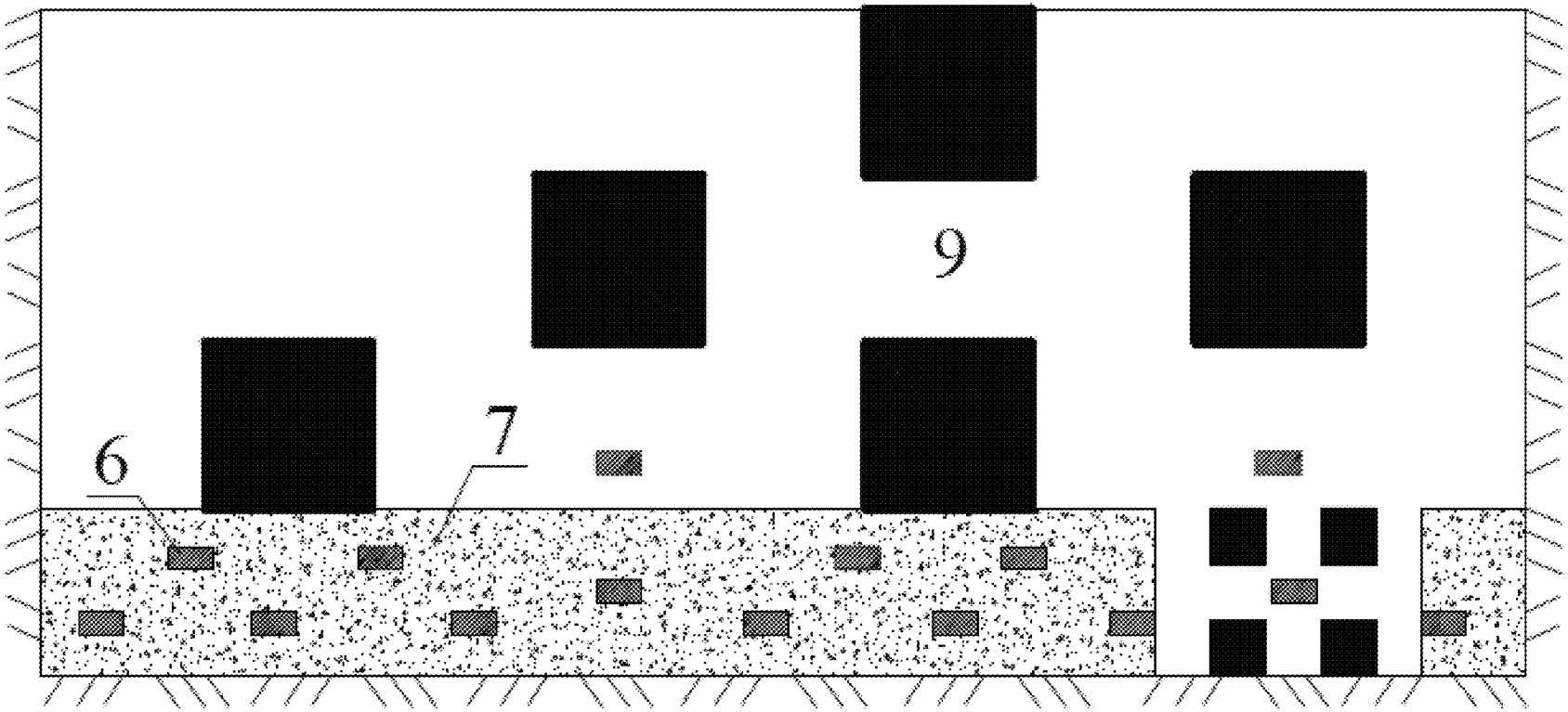
FIG. 4(*a*) is a top view of recovering and filling state in the method for recovering room-mining coal pillars by solid filling in synergy with artificial pillars according to the present invention.
Figure 4B:
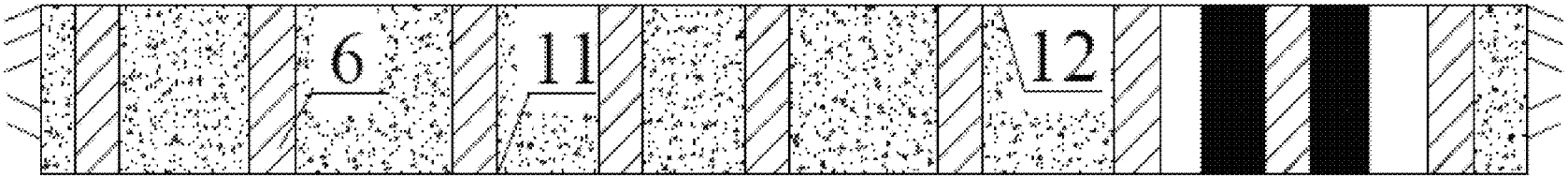

In the figures: 1—feeding well, 2—conveying pipeline, 3—solid material, 4—cementing material, 5—room-mining coal pillar, 6—artificial pillar, 7—coal room filler, 8—gangue casting machine, 9—room-and-pillar goaf, 10—continuous coal mining machine, 11—pillar groove, 12—roof.

DETAILED DESCRIPTION OF THE INVENTION

Embodiments of the present invention are further described below with reference to the accompanying drawings.

A method for recovering room-mining coal pillars by solid filling in synergy with artificial pillars provided by the present invention includes the following steps:

a. Under a joint support to overlying strata by a filler in synergy with artificial pillars, adopting a method of recovering room-mining coal pillars 5 by a continuous coal mining machine: firstly, conveying solid materials 3 and cementing materials 4 on a ground through a feeding well 1 and a conveying pipeline 2 to a room-and-pillar goaf 9.

b. Casting a plurality of artificial pillars 6 at an interval in the room-and-pillar goaf 9 between the room-mining coal pillars 5, while casting gangue to fill the room-and-pillar goaf between the cast artificial pillars 6 using a gangue casting machine 8, and tamping and reinforcing using a bulldozer, to form a coal room filler 7, where the artificial pillars 6 are cast at an interval of 15 m to 17 m, most preferably 16 m.

c. Under the joint support by the cast artificial pillars 6 and the coal room filler 7, recovering the room-mining coal pillars 5 one-by-one in a joint support area using the continuous coal mining machine 10, casting artificial pillars 6 in the original coal pillar area after recovery, and casting gangue to fill the original coal pillar area using the gangue casting machine till all the room-mining coal pillars are recovered. A system for recovering room-mining coal pillars by solid filling in synergy with artificial pillars mainly includes a material conveying system, a joint support system, and a coal pillar recovery system.

The recovery process of a single room-mining coal pillar includes the following steps:

a. Firstly constructing square pillar grooves 11, having sides of 4 m long, for building retaining walls and carrying out artificial casting at an interval in the room-and-pillar goaf 9 on one side of the room-mining coal pillar 5, and building retaining walls in the constructed square pillar grooves 11, where the retaining walls are required to be tightly sealed and contact a roof 12 completely and closely.

b. Constructing artificial pillars 6 by injecting slurry into the constructed square pillar grooves 11, where during casting of the artificial pillars 6, the casting is carried out many times from bottom to top in order to avoid uneven strength in the vertical direction of the artificial pillars 6 that is caused by segregation of the slurry in the case of one-time filling; and when the height of the slurry for casting the artificial pillars 6 reaches a position that is 50 mm below the roof 12, increasing the concentration of the slurry and performing roof-contacted filling on the artificial pillars 6.

c. After casting of the artificial pillars 6, casting gangue to fill the room-and-pillar goaf 9 using the gangue casting machine 8, and also, tamping and reinforcing using the bulldozer.

d. Repeating Steps a to c to complete filling of the room-and-pillar goaf 9 on the other side of the room-mining coal pillar 5.

e. After a strength of the artificial pillars 6 and the coal room filler 7 reaches initial rock stress, recovering the room-mining coal pillar 5 using the continuous coal mining machine 10 in a horizontal recovery manner, the recovery being carried out in a cross-shuttling order.

f. Casting artificial pillars 6 in the area of the recovered room-mining coal pillar 5, and casting gangue to fill the area of the room-mining coal pillar 5 using the gangue casting machine 8, thus achieving "mining first and filling later" on a working face.

What is claimed is:

1. A method for recovering room-mining coal pillars by solid filling in synergy with artificial pillars, comprising the following steps:

a. under a joint support to overlying strata by a filler in synergy with artificial pillars, recovering room-mining coal pillars using a continuous coal mining machine: firstly, conveying solid materials and cementing materials on a ground level through a feeding well and a conveying pipeline to a room-and-pillar goaf;

b. casting a plurality of artificial pillars at an interval in the room-and-pillar goaf among the room-mining coal pillars, filling areas with a filling material among the cast artificial pillars, and tamping and reinforcing a combined structure of the cast artificial pillars and the filling material, to form a coal room filler;

c. under the joint support by the cast artificial pillars and the coal room filler, recovering the room-mining coal pillars one-by-one in a joint support area using the continuous coal mining machine till all the room-mining coal pillars are recovered;

wherein the recovery process of a single room-mining coal pillar comprises the following steps:

a1. firstly constructing square pillar grooves having sides of 4 m long at an interval in the room-and-pillar goaf on one side of the room-mining coal pillar, and building retaining walls in the constructed square pillar grooves, wherein the retaining walls in each of the square pillar grooves contact a roof and are configured to define a sealed space;

b1. constructing artificial pillars by injecting slurry into the constructed square pillar grooves, and when a height of the slurry for casting the artificial pillars reaches a position that is 50 mm below the roof, increasing a concentration of the slurry and performing roof-contacted filling on the artificial pillars;

c1. after casting of the artificial pillars, casting the filling material to fill the room-and-pillar goaf using a gangue casting machine, and also, tamping and reinforcing the combined structure using a bulldozer, wherein the filling material comprises gangue;

d1. repeating Steps a1 to c1 to complete filling of the room-and-pillar goaf on the other side of the room-mining coal pillar;

e1. after a strength of the artificial pillars and the coal room filler reaches a strength of an ambient rock structure, recovering the room-mining coal pillar using the continuous coal mining machine in a horizontal recovery manner by firstly forming a cross-shaped recovered space;

f1. casting artificial pillars in the area of the recovered room-mining coal pillar, and casting gangue to fill the area of the recovered room-mining coal pillar using the gangue casting machine.

2. The method for recovering room-mining coal pillars by solid filling in synergy with artificial pillars according to claim 1, wherein the artificial pillars are cast at an interval of 15 m to 17 m.

* * * * *